US006775504B2

(12) United States Patent
Godlove et al.

(10) Patent No.: US 6,775,504 B2
(45) Date of Patent: Aug. 10, 2004

(54) DEVELOPER MEMBER ADAPTED FOR DEPOSITING DEVELOPER MATERIAL ON AN IMAGING SURFACE

(75) Inventors: Ronald E. Godlove, Bergen, NY (US); Richard F. Koehler, Jr., Webster, NY (US); Christopher Snelling, Rochester, NY (US); Dale R. Mashtare, Bloomfield, NY (US); Robert W. Phelps, Victor, NY (US)

(73) Assignee: Xerox Corporation, Stamford, CT (US)

( * ) Notice: Subject to any disclaimer, the term of this patent is extended or adjusted under 35 U.S.C. 154(b) by 5 days.

(21) Appl. No.: 10/320,822

(22) Filed: Dec. 16, 2002

(65) Prior Publication Data

US 2004/0114967 A1 Jun. 17, 2004

(51) Int. Cl.[7] ..... G03G 15/08; G03G 15/09
(52) U.S. Cl. ..... 399/266; 399/267
(58) Field of Search ..... 399/266, 267, 399/270–277

(56) References Cited

U.S. PATENT DOCUMENTS

| | | | | |
|---|---|---|---|---|
| 4,233,387 A | | 11/1980 | Mammino et al. | 430/137 |
| 4,345,014 A | | 8/1982 | Oka et al. | 430/122 |
| 4,546,060 A | | 10/1985 | Miskinis et al. | 430/108 |
| 4,937,166 A | | 6/1990 | Creatura et al. | 430/108 |
| 5,505,760 A | | 4/1996 | Jansson | 75/255 |
| 5,742,884 A | * | 4/1998 | Germain et al. | 399/266 |
| 6,088,562 A | * | 7/2000 | Belkhir et al. | 399/266 |
| 6,143,456 A | | 11/2000 | Silence et al. | 430/106.6 |

* cited by examiner

*Primary Examiner*—William J. Royer
(74) *Attorney, Agent, or Firm*—Lloyd F. Bean, II

(57) ABSTRACT

In a development system including a developer transport adapted for depositing developer material on an imaging surface having an electrostatic latent image thereon, including: a housing defining a chamber storing a supply of developer material including carrier and toner; a donor member, mounted partially in the chamber and spaced from the imaging surface, for transporting developer on an outer surface thereof to a region opposed from the imaging surface the donor member having a magnetic assembly having a plurality of poles, a sleeve, enclosing the magnetic assembly, rotating about the magnetic assembly; the magnetic assembly generating a developer bed having a predefined developer bed height; a grid, interposed between the donor roll and the imaging surface within the predefined bed height, the grid having apertures for permitting carrier and toner therethrough; and means for biasing a region between the grid and the imaging surface at a voltage potential so that toner is ejecting towards the imaging surface after toner passes the apertures of the grid.

11 Claims, 4 Drawing Sheets

DEVELOPER MEMBER ADAPTED FOR DEPOSITING DEVELOPER MATERIAL ON AN IMAGING SURFACE

BACKGROUND AND SUMMARY OF THE PRESENT INVENTION

The invention relates generally to an electrophotographic printing machine and, more particularly, to a development system which includes a magnetic developer roll for transporting magnetic developer materials to a development zone; and a magnetic system for generating a magnetic field to reduce developer material bed height in the development zone.

Generally, an electrophotographic printing machine includes a photoconductive member which is charged to a substantially uniform potential to sensitize the surface thereof. The charged portion of the photoconductive member is exposed to an optical light pattern representing a document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to control developer adhesion. The rotation of the sleeve transports magnetically adhered developer through the development zone where there is direct contact between the developer brush and the imaged surface, and charged toner particles ware stripped from the passing magnetic brush filaments by the electrostatic fields of the image.

These systems can employ magnetically hard ferromagnetic material, for example U.S. Pat. No. 4,546,060 discloses an electrographic, two-component dry developer composition comprising charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. Magnetically "hard" carrier materials include strontium ferrite and barium ferrite, for example. These carrier materials tend to be electrically insulative as employed in electrophotographic development subsystems. The developer is employed in combination with a magnetic applicator comprising a rotatable magnetic core, and an outer, nonmagnetizable shell to develop electrostatic images.

Non-interactive development is most useful in color systems when a given color toner must be deposited on an electrostatic image without disturbing previously applied toner deposits of a different color or cross-contaminating the color toner supplies.

It has been observed in systems employing magnetically hard ferromagnetic material that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, substantial clearance must be provided in the development gap to avoid photoconductive member interactions through direct physical contact, so that the use of a closely spaced development electrode critical to high fidelity image development is precluded. The effective development electrode is essentially the development sleeve surface in the case of insulative development systems although for conductive magnetic brush systems the effective electrode spacing is significantly reduced.

It has also been found that in the fixed assembly of permanent magnets, the magnetic pole spacing thereof cannot be reduced to an arbitrarily small size because allowance for the thickness of the sleeve and a reasonable mechanical clearance between the sleeve and the rotating magnetic core sets a minimum working range for the magnetic multiple forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

The above problems with controlling developer bed height are exacerbated when magnetically soft carrier material is employed such as disclosed in U.S. Pat. Nos. 6,143,456; 4,937,166; 4,233,387; 5,505,760; and 4,345,014 which are hereby incorporated by reference. U.S. Pat. No. 4,345,014 discloses a magnetic brush development apparatus which utilizes a two-component developer of the type described. The magnetic applicator is of the type in which the multiple pole magnetic core rotates to effect movement of the developer to a development zone. The magnetic carrier disclosed in this patent is of the conventional variety in that it comprises relatively "soft" magnetic material (e.g., magnetite, pure iron, ferrite or a form of $Fe_3O_4$). having a magnetic coercivity, Hc, of about 100 gauss or less. Such soft magnetic materials have been preferred heretofore because they inherently exhibit a low magnetic remittance, $B_R$, (e.g., less than about 5 EMU/gm) and a high induced magnetic moment in the field applied by the brush core.

It is desirable to use magnetically soft carrier material because having a low magnetic reemergence, soft magnetic carrier particles retain only a small amount of the magnetic moment induced by a magnetic field after being removed from such field; thus, they easily intermix and replenish with toner particles after being used for development. Additionally, conductive carrier material options are significantly broadened for the "soft" magnetic carriers. Also having a relatively high magnetic rmoment when attracted by the brush core, such materials are readily transported by the rotating brush and are prevented from being picked up by the photoconductive member during development.

SUMMARY OF THE INVENTION

The present invention obviates the problems noted above by utilizing a development system including a developer transport adapted for depositing developer material on an imaging surface having an electrostatic latent image thereon, comprising: a housing defining a chamber storing a supply of developer material comprising carrier and toner; a donor member, mounted partially in said chamber and spaced from the imaging surface, for transporting developer on an outer surface thereof to a region opposed from the imaging surface said donor member having a magnetic assembly having a plurality of poles, a sleeve, enclosing said magnetic assembly, rotating about said magnetic assembly; said magnetic assembly generating a developer bed having a predefined developer bed height; a grid, interposed between said donor member and the imaging surface within said predefined developer bed height, said grid having apertures for permitting carrier and toner therethrough; and means for biasing a region between said grid and said imaging surface at a voltage potential so that toner is ejecting towards the imaging surface after toner passes the apertures of said grid.

DETAILED DESCRIPTION

Figure 1:
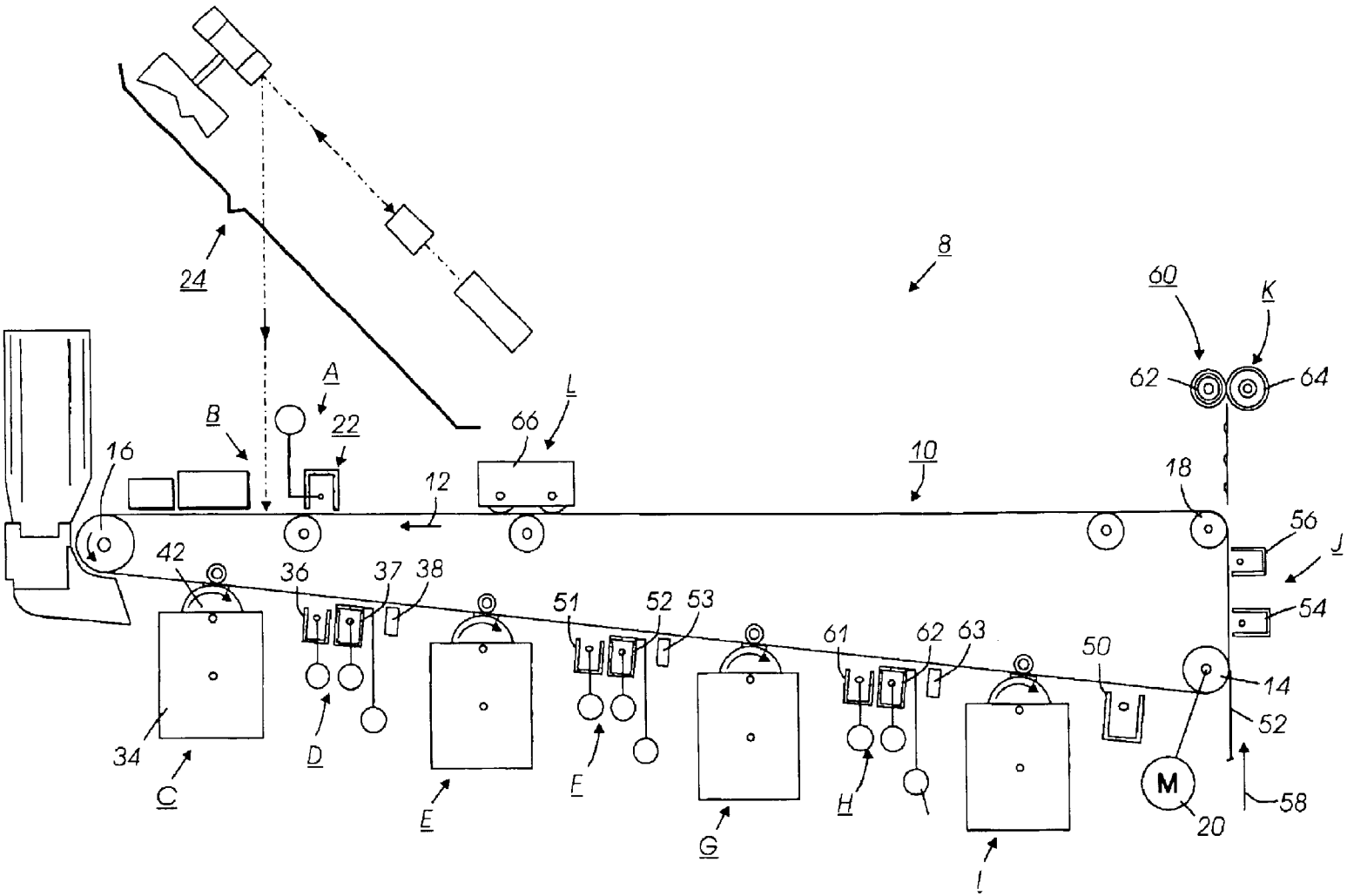
FIG. 1 is a schematic elevational view of an illustrative electrophotographic printing or imaging machine or apparatus incorporating a development apparatus having the features of the present invention therein.

For a general understanding of the present invention, reference is made to the drawings. In the drawings, like reference numerals have been used throughout to designate identical elements. FIG. 1 shows a schematic elevational view of an electrophotographic printing machine incorporating the features of the present invention therein. It will become evident from the following discussion that the present invention is equally well suited for use in a wide variety of printing systems, and is not necessarily limited in its application to the particular system shown herein.

Now referring to FIG. 1, there is shown an illustrative electrophotographic machine having incorporated therein the development apparatus of the present invention. An electrophotographic printing machine 8 creates a color image in a single pass through the printing machine 8 and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the photoreceptor belt 10 about a drive roller 14 and two tension rollers 16 and 18 and then rotating the drive roller 14 via a drive motor 20.

As the photoreceptor belt 10 moves, each part of it passes through each of the subsequently described process stations. For convenience, a single section of the photoreceptor belt 10, referred to as an image area, is identified. The image area is that part of the photoreceptor belt 10 which is to receive toner powder images which, after being transferred to a substrate, produce a final image. While the photoreceptor belt 10 may have numerous image areas, since each image area is processed in the same way, a description of the typical processing of one image area suffices to fully explain the operation of the printing machine 8.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At first exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention.

After passing through the first exposure station B, the now exposed image area passes through a first development station C which is identical in structure with development stations E, G, and I. The first development station C deposits a first color, say black, of negatively charged toner onto the image area. That toner is attracted to the less negative sections of the image area and repelled by the more negative sections. The result is a first toner powder image on the image area.

Figure 3:
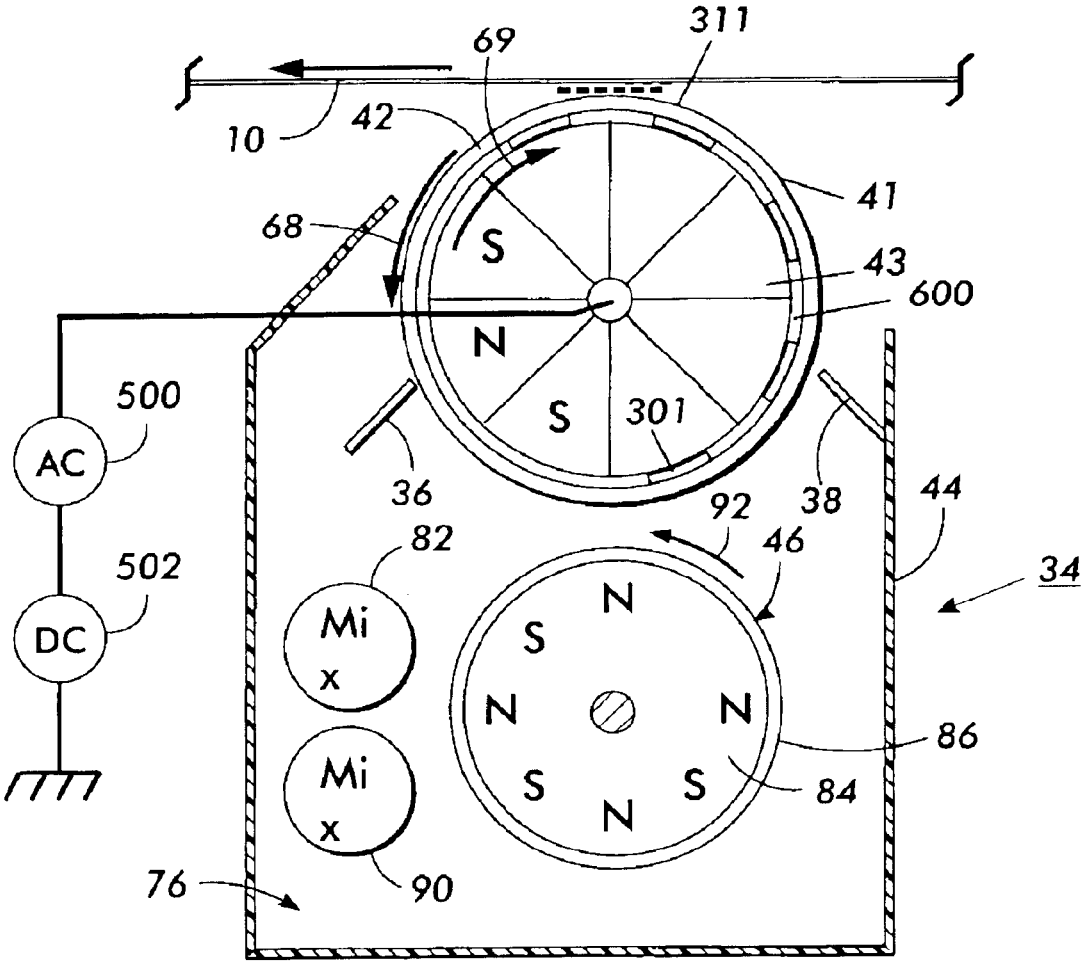
FIGS. 3 and 4 are schematic views showing a development apparatus having the features of the present invention therein.

For the first development station C, development system 34 includes a donor roll 42. Donor roll 42 is mounted, at least partially, in the chamber of developer housing 44 (FIG. 3). The chamber in developer housing 44 stores a supply of developer (toner) material that develops the image. Toner (which generally represents any color of toner) adheres to the illuminated image area.

After passing through the first development station C, the now exposed and toned image area passes to a first recharging station D. The first recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices 36 and 37 to accomplish their task.

After being recharged at the first recharging station D, the now substantially uniformly charged image area with its first toner powder image passes to a second exposure station 38. Except for the fact that the second exposure station 38 illuminates the image area with a light representation of a second color image (say yellow) to create a second electrostatic latent image, the second exposure station 38 is the same as the first exposure station B.

The image area then passes to a second development station E. Except for the fact that the second development station E contains a toner which is of a different color (yellow) than the toner (black) in the first development station C, the second development station E is beneficially the same as the first development station C. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, 51 and 52, respectively, which operate similar to the recharging devices 36 and 37. Briefly, the first recharging device 51 overcharges the image areas to a greater absolute potential than that ultimately desired (say −700 volts) and the second recharging device 52, comprised of coronodes having AC potentials, neutralizes that potential to that ultimately desired.

The now recharged image area then passes through a third exposure station 53. Except for the fact that the third exposure station 53 illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station H includes a pair of recharging devices 61 and 62 which adjust the voltage level of both the toned and untoned parts of the image area to a substantially uniform level in a manner similar to the recharging devices 36 and 37 and recharging devices 51 and 52.

After passing through the third recharging station H the now recharged image area then passes through a fourth exposure station 63. Except for the fact that the fourth exposure station 63 illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pre-transfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet 52 is advanced to the transfer station J in the direction 58 by a conventional sheet feeding apparatus which is not shown. The transfer station J includes a transfer corona device 54 which sprays positive ions onto the backside of support sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the support sheet 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 2:
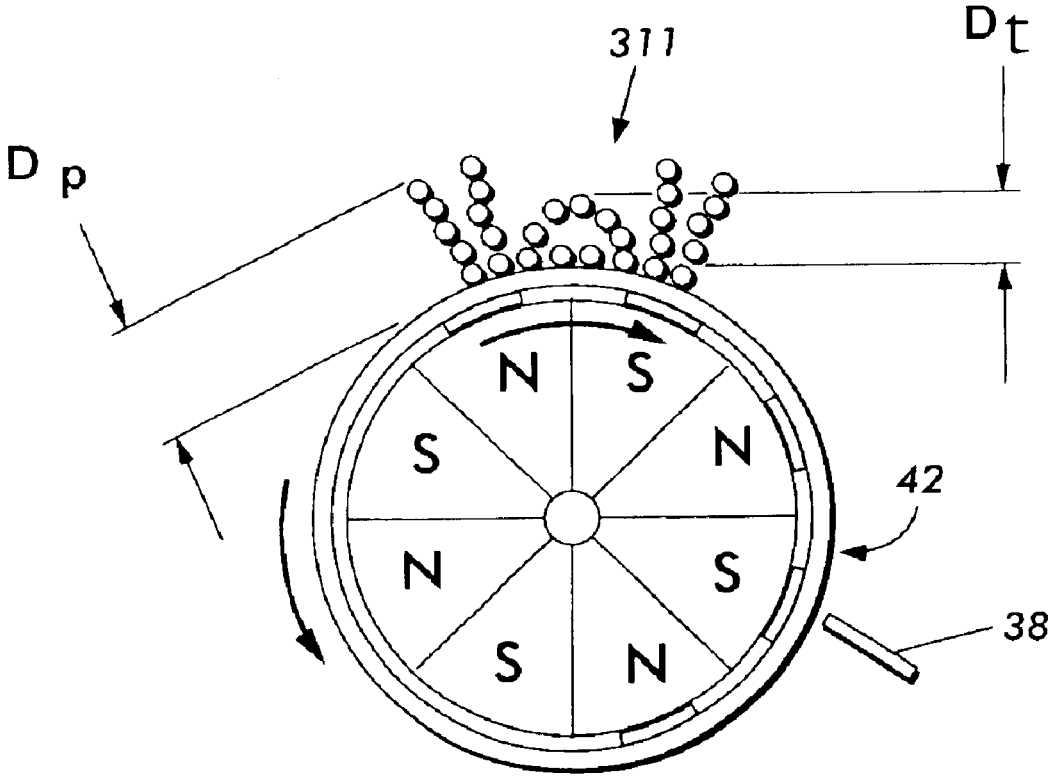
FIG. 2 is a schematic view showing variations in the developer bed height of the development apparatus used in the FIG. 1 printing machine.
Figure 4:
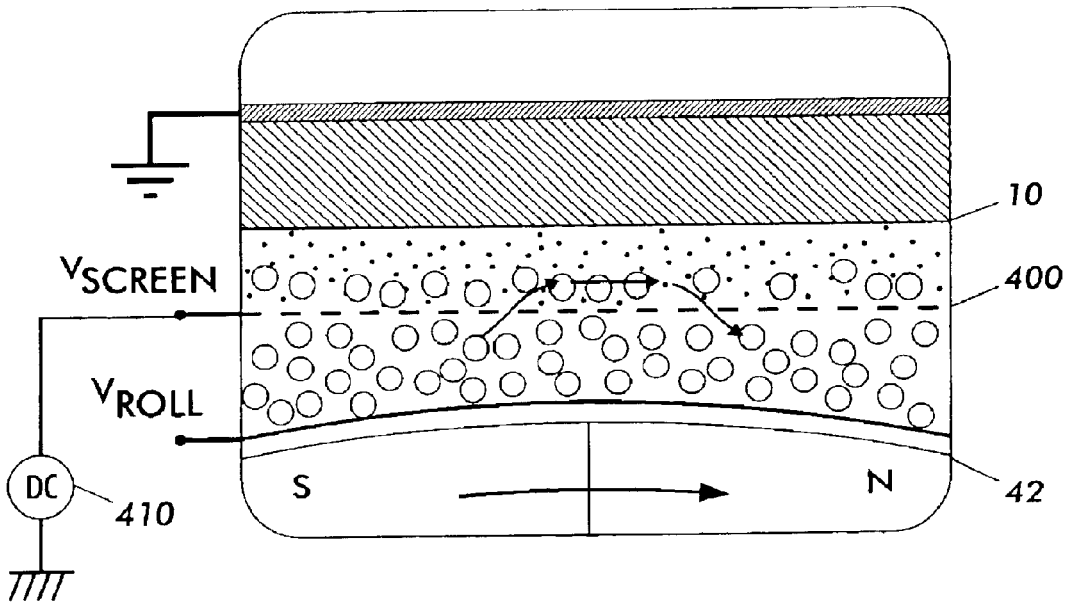

Focusing on a development process, developer material is magnetically attracted toward a magnetic assembly of a donor roller forming brush filaments corresponding to magnetic field lines present above the surface of a sleeve. It has been observed that carrier beads tend to align themselves into chains that extend normal to a development roll surface over pole faces and lay down parallel to the roll surface between pole faces where the magnetic field direction is tangent to the roll surface. The net result is that an effective developer bed height varies from a maximum over pole face areas to a minimum over pole transition areas. This effect is illustrated in FIG. 2. Rotation of the magnetic assembly causes the developer material, to collectively tumble and flow due to the response of permanent magnetic carrier particles to the changes in magnetic field direction and magnitude caused by an internal rotating magnetic roll. This flow is in a direction "with" the photoreceptor belt 10 in the arrangement depicted in FIG. 4. Magnetic agitation of the carrier which serves to reduce adhesion of the toner particles to the carrier beads is provided by this rotating harmonic multiple magnetic roll within the development roll surface on which the developer material walks.

In the desired noninteractive development mode carrier beads must be prevented from touching the photoreceptor belt surface or any previously deposited toner layers on the photoreceptor belt 10. This is to prevent disturbance of the previously developed toner image patterns that are being combined on the photoreceptor belt surface to create composite color images. The variation in developer bed height illustrated in FIG. 2 forces the minimum spacing between the photoreceptor belt 10 and the developer bed surface to be determined by the bed height at the pole areas where the bed height $D_p$ is largest in order to prevent interaction. The average spacing achieved in this manner is then determined by the average bed height which will be greater than the minimum bed height—i.e. $(D_p+D_t)/2>D_t$.

Referring now to FIG. 3 in greater detail, development system 34 includes a housing 44 defining a chamber 76 for storing a supply of developer material therein. Donor roll 42 comprises an interior rotatable harmonic multiple magnetic assembly 43 and an outer sleeve 41. The sleeve 41 can be rotated in either the "with" or "against" direction relative to the direction of motion of the photoreceptor belt 10. Similarly, the magnetic assembly 43 can be rotated in either the "with" or "against" direction relative to the direction of motion of the sleeve 41. Preferably, sleeve 41 has a thickness about 100 to 350 microns and magnetic assembly 43 has a pole spacing from 1 mm to 1 cm. The relative rotation is between 200 to 2000 rpm. It is preferred to adjust the parameters of pole spacing, sleeve thickness and relative rotation to achieve 6–10 flips of bead chains which is accomplished by sliding the bead chain from being over one type of magnetic pole (e.g., N) within the development sleeve 41 to being over the opposite type of magnetic pole (e.g., S) in the development zone 311 to attain a sufficient toner supply to develop to field collapse.

In FIG. 3, the sleeve 41 is shown rotating in the direction of arrow 68 that is the "with" direction of the photoreceptor belt 10 and magnetic assembly 43 is rotated in the direction of arrow 69. Blade 38 is placed in near contact with the rotating donor roll 42 to trim the height of the developer bed. Blade 36 is placed in contact with the rotating donor roll 42 to continuously remove developer from the donor roll 42 for return to the developer chamber 76.

A DC and AC bias is applied to sleeve 41 by power supply 500, which serves as the development electrode, to effect the necessary development bias with respect to the image potentials present on the photoreceptor belt 10.

Magnetic roller 46 advances a constant quantity of developer onto donor roll 42. This ensures that donor roller 42 provides a constant amount of developer with an appropriate toner concentration into the development zone 311. Magnetic roller 46 includes a non-magnetic tubular member 86 made preferably from aluminum and having the exterior circumferential surface thereof roughened. An elongated magnet 84 is positioned interiorly of and spaced from the tubular member 86. The magnet 84 is mounted stationary and includes magnetized regions appropriate for magnetic pick up of the developer material from the developer chamber 76 and a nonmagnetized zone for developer material drop off. The tubular member 86 rotates in the direction of arrow 92 to advance the developer material adhering thereto into a loading zone formed between magnetic roller 46 and donor roll 42. In the loading zone, developer material is preferentially magnetically attracted from the magnetic roller 46 onto the donor roll 42. Augers 82 and 90 are mounted rotatably in chamber 76 to mix and transport developer material. The augers 82 and 90 have blades extending spirally outwardly from a shaft. The blades are designed to advance the developer material in a direction substantially parallel to the longitudinal axis of the shaft.

The present invention can employ magnetic carrier of the conventional variety in that it comprises relatively "soft" magnetic material (e.g., magnetite, pure iron, ferrite or a form of $Fe_3 O_4$) having a magnetic coercivity, Hc, of about 100 gauss or less. Such soft magnetic materials have been preferred heretofore because they inherently exhibit a low magnetic remittance, $B_R$, (e.g., less than about 20 EMU/gm but preferably less than 5 EMU/gm) in a high induced magnetic moment in the field applied by the brush core. Commonly applied examples of soft carrier material include copper zinc ferrite (CuZn ferrites) or nickel zinc (NiZn ferrites) core materials. Other materials which may be classified as soft magnetic carriers can include magnetite, pure iron, or ferrite (Fe3O4 for example). These materials will exhibit reduced magnetic saturation and lower coercivity values than that of the hard magnetic materials.

The present invention employs a screen or otherwise grid like conductive element 400 which acts to spilt the regimes of AC and DC blasing in a development nip to accomplish the elimination of halo and related electrostatic latent Image fringe field induced development problems. Applicants have found that limiting the action of the AC bias to the region between the screen 400 and the donor roller 42 allows the establishment of DC bias induced time stable potential wells or fringe fields between the screen 400 and the photoreceptor belt surface that determine the destinatlon of toner particles onto the photoreceptor belt surface, overcoming the electrostatic latent image fringe fields that otherwise deflect toner from some of the desired locations on the latent image. Screen induced artifacting on the uniformity of the developed images can be eliminated by proper screen design and its orientation with respect to the process direction. Lateral motion of the screen 400 in a vibratory or continuous mode can also smooth out screen induced variations in developed densities. Scavenging of previously laid down toner images has so far been seen to be absent.

The present invention uses the screen 400 as reference electrode in a development nip. The screen 400 is placed within the bead height so that the bead chain slightly contacts the screen 400. The screen 400 is preferably placed between 200 to 800 microns from the photoreceptor belt surface. The screen 400 is biased DC by power supply 410. The aperture size of the screen 400 allows both toner and carrier to pass therethrough. Applicants have found that the carrier that passes through is attracted back through the screen 400 to the donor roll 42 due to AC field between the donor roll 42 and screen 400 and magnetic field of the donor roll 42. In operation the passes of carrier back through the screen 400 acts to clean the screen 400.

The carrier diameter size is between 10 mm and 100 mm. The aperture size is between 50 mm and 1 mm. The AC power supply applies an AC voltage potential of 200 volts and 2000 volts at a frequency between 1 kHz and 100 kHz.

Applicants have found that a screen 400 is desirable when the required development gap is so large that the existence of electrostatic latent image fringe fields deflect toner particles from their desired destinations. The screen 400 was theorized to be of value only in that it reduced the size of the gap or prevented carrier bead printout. If when installing such a screen 400 in a development gap, the screen 400 is also used to split the influences of AC and DC biases, DC biasing existing between the screen 400 and the electrostatic latent image can maintain the existence of potential wells or fringe fields that determine the path and destination of toner particles, thus enabling the overcoming of halo and related electrostatic latent image induced development problems for gaps greater than that which can be accomplished by not splitting the biases into two different regions. Furthermore, the latitudes of DC and AC biasing are widened by separating their areas of influence. Bead slinging caused by an excessively high peak to peak AC bias voltage, or an excessively low frequency of the same has not as yet been observed in such an arrangement. Since the AC bias field is strongly limited to the region between the screen 400 and the developer source (roll or other), its action cannot extend to any appreciable extent into the region of DC only bias existing between the screen 400 and the toner receiver. Such an arrangement has been shown to work for a screen 400 to receiver gap of greater than 0.030", which further reduces the influence of the AC biasing field close to the toner receiver.

This also provides the additional opportunity to tailor the DC biasing to the development and reduce background for instance, while reducing or eliminating the bead slinging interactions that otherwise require close attention when the biases are not split into two different regions. Additionally, the AC or mixed AC and DC biasing that can exist between the screen 400 and the donor roll 42 can be tailored to the purpose of agitating the developer to the desired extent without fear of inducing carrier bead printout on the toner receiver.

Principles of the present invention were tested in which an existing image developed 0.025 inches away from the screen 400 with DC bias only between the screen 400 and the receiver was then subjected to 10 passes of a reverse development field of 50 volts in the cleaning field direction with respect to the zero development bias voltage. No indications of scavenging at all were detectable.

As might be expected, practical screens or gridlike elements of less than 100% openness can induce line like non-uniformities in the developed image. It has been shown that this can be eliminated by the correct angular orientation of the screen pattern, along with the choice of a correct pattern of screen. It has also been shown to be possible to eliminate such screen 400 induced line artifacting by movement of the sceen in such a way that the non-uniformities are smoothed out. This can be accomplished by back and forth vibration of the screen 400 in the plane of the process and perpendicular to the direction of the process direction. This can also be accomplished by a continuous movement of the screen 400 in the same direction. When the bottom of the screen 400 is in grazing contact with the developer brush, the contact of developer with the screen 400 keeps any more than a partial monolayer of toner from forming.

A real reference electrode in the form of a screen 400 or other gridlike element or an arrangement by the splitting of the AC and DC biases such as to employ potential wells or fringe fields to direct toner to all intended to be developed upon regions of an electrostatic latent image on a toner receiver. This also includes biasing arrangements that while allowing DC bias only between the screen 400 and the toner receiver, a mixture of AC and DC biasing can exist between the screen 400 and the donor roll 42 or other toner source.

The design of the screen 400 and the orientation of the screen 400 with respect to the process direction can be employed to eliminate screen 400 induced artifacting taking the form of non-uniformities in the developed image. Motion of the screen 400 in the plane of the development process and a partial or total amount of motion perpendicular to the process direction can also be used to eliminate screen 400 induced artifacting taking the form of non-uniformities in the developed image. This motion can be oscillatory (vibrational) or continuous in its nature.

While the invention has been described with reference to the structures disclosed, it is not confined to the specific details set forth, but is intended to cover such modifications or changes as may come within the scope of the following claims:

What is claimed is:

1. In a development system including a developer transport adapted for depositing developer material on an imaging surface having an electrostatic latent image thereon, comprising:

a housing defining a chamber storing a supply of developer material comprising carrier and toner;

a donor member, mounted partially in said chamber and spaced from the imaging surface, for transporting developer material on an outer surface thereof to a region opposed from the imaging surface said donor member having a magnetic assembly having a plurality of poles, a sleeve, enclosing said magnetic assembly, rotating about said magnetic assembly; said magnetic assembly generating a developer bed having predefined developer bed height;

a grid, between said donor member and the imaging surface within said predefined developer bed height, said grid having apertures for permitting carrier and toner therethrough; and means for biasing a region between said grid and said imaging surface at a voltage potential so that toner is ejecting towards the imaging surface after toner passes the apertures of said grid.

2. The development system of claim 1, wherein said voltage potential generates an electric field having a substantial DC component.

3. The development system of claim 2, wherein said voltage potential is between 0 and 1000 volts DC.

4. The development system of claim 1, further comprising means for generating an AC field between said grid and donor member so that carrier is inhibited from reaching said imaging surface.

5. The development system of claim 4, wherein said AC generating means includes an AC power supply, said AC power supply applying an AC voltage potential of 200 volts and 2000 volts at a frequency between 1 kHz and 100 kHz.

6. The development system of claim 1, wherein said magnetic assembly has a predefined magnetic strength so that carrier is inhibited from reaching said imaging surface and passes through the grid back to said donor member.

7. The development system of claim 1, wherein the carrier has a diameter size is between 10 mm and 100 mm.

8. The development system of claim 1, wherein the grid has an aperture size is between 50 mm and 1 mm.

9. The development system of claim 1, wherein said grid is spaced from 200 mm and 800 mm from said donor member and is from 200 mm and 800 mm from said imaging surface.

10. The development system of claim 1, further comprising means for cleaning said grid.

11. The development system of claim 10, wherein said cleaning means includes a vibrational element.

* * * * *